US007298386B1

(12) United States Patent
Sharp et al.

(10) Patent No.: US 7,298,386 B1
(45) Date of Patent: Nov. 20, 2007

(54) SEQUENTIAL COLOR DISPLAY SYSTEM AND METHOD

(75) Inventors: Gary D. Sharp, Boulder, CO (US); Michael G. Robinson, Boulder, CO (US); Jianmin Chen, Superior, CO (US)

(73) Assignee: ColorLink, Inc., Boulder, CO (US)

( * ) Notice: Subject to any disclaimer, the term of this patent is extended or adjusted under 35 U.S.C. 154(b) by 349 days.

(21) Appl. No.: 10/438,778

(22) Filed: May 14, 2003

Related U.S. Application Data

(60) Provisional application No. 60/378,107, filed on May 14, 2002.

(51) Int. Cl.
*G09G 5/10* (2006.01)

(52) U.S. Cl. ..... 345/690

(58) Field of Classification Search ..... 345/600, 345/88, 698, 205, 691, 589, 119, 117
See application file for complete search history.

(56) References Cited

U.S. PATENT DOCUMENTS 5,185,602 A * 2/1993 Bassetti et al. ..... 345/89
5,671,018 A * 9/1997 Ohara et al. ..... 348/452
6,295,054 B1 * 9/2001 McKnight ..... 345/205
6,369,832 B1 * 4/2002 McKnight ..... 345/691
6,388,718 B1 * 5/2002 Yoo et al. ..... 349/9
6,621,476 B2 * 9/2003 Walton et al. ..... 345/87
2001/0026261 A1 * 10/2001 Walker et al. ..... 345/98
2002/0008712 A1 * 1/2002 Shigeta ..... 345/690

* cited by examiner

*Primary Examiner*—Kee M. Tung
*Assistant Examiner*—Aaron M. Richer
(74) *Attorney, Agent, or Firm*—Baker & McKenzie LLP

(57) ABSTRACT

A sequential color system with reduced or eliminated global temporal notching losses may be implemented with a buffered display panel. Fast global blanking and/or inter-field images may be used to reduce or eliminate the global temporal notching losses. When consecutive states of a pixel are "on," an inter-field image may be displayed by maintaining the pixel in an "on" state instead of turning the pixel "off" and then turning the pixel "on." This improves the color brightness and saturation. The display may be implemented with a color wheel or with a color switch.

26 Claims, 5 Drawing Sheets

SEQUENTIAL COLOR DISPLAY SYSTEM AND METHOD

CROSS-REFERENCE TO RELATED APPLICATION

The present application claims priority from U.S. Provisional Application entitled "Sequential Color Display and Method," Ser. No. 60/378,107, filed May 14, 2002, having Gary D. Sharp, Michael G. Robinson, and Jianmin Chen as inventors, and having as assignee ColorLink, Inc., the assignee of the present application. This provisional application is incorporated herein by reference in its entirety for all purposes.

TECHNICAL FIELD

The present application relates generally to displaying and driving methods of sequential color systems, and more particularly to displaying and driving methods of sequential color systems with reduced global temporal notching.

BACKGROUND

A progressive-scan active matrix display panel may be written line-by-line to operate in a scrolling mode with continuous viewing. The brightness and color saturation are reduced in sequential systems, which illuminate a large portion or the entire active matrix display panel with a rapid succession of different colors, because of the blanking times used to write images onto the active matrix display panel. The blanking time may be increased by many factors. For example, the time required to write the entire display, the settling time or switching time of the display, the transition time between colors for the light source, and other factors. Accordingly, an active matrix display panel and driving methods are needed that improve one or more of color saturation, brightness, and blanking time.

SUMMARY

The present application describes various aspects of sequential color systems including a buffered panel with a plurality of pixels. In embodiments described in this application, pixels that are transitioning between two color image components and have "on" transmission states in both of the two color image components, are maintained in the "on" state during the transition between the two color image components.

In some embodiments, a method is described for driving a sequential color system including loading data into buffers of a plurality of pixels and writing the data to the plurality of pixels from the buffers. The pixels that are transitioning between two color image components and have "on" transmission states in the two components are maintained in the "on" state during the transition.

In some variations, the method includes loading data into buffers of a plurality of pixels, turning the plurality of pixels off and then writing the data to the plurality of pixels. In some embodiments, the turning off of the plurality of pixels is performed simultaneously and the writing of the data to the plurality of pixels is performed simultaneously. In some variations, the plurality of pixels are simultaneously driven to a black state and then simultaneously written.

In some embodiments, a method for driving a color display system is described. In some embodiments, the method includes maintaining a transmission state of one or more pixels of the display during transition from a first color image component to a second color image component, if the transmission state of one or more pixels in the first color image component is the same as the transmission state of one or more pixels in the second color image component. In some variations, the method includes loading data into one or more buffers corresponding to the images in the color display system. The method further includes writing the data to the one or more pixels from the corresponding one or more buffers.

In some embodiments, the method includes displaying an inter-field image during the color transition from the light of first color to the light of second color, wherein the inter-field image is configured to maintain the transmission state of the one or more pixels. In some variations, the method includes, if the transmission state of the one or more pixels in the light of second color image component is not same as the transmission state of the one or more pixels in the first color image component, changing the transmission state of the one or more pixels concurrently with the color transition from the first color image component to the second color image component. Further, in some embodiments, a color display system is described as having a display panel including one or more pixels, and also having one or more buffers coupled to the display panel and corresponding to one or more color image components.

Color display systems disclosed in this application may be configured to load data into one or more buffers corresponding to one or more color image components and to write data into one or more panels corresponding to the one or more color image components. The color system may include a color wheel or a color switch coupled to the display panel, where the color wheel or color switch may be configured to pass light of a certain color spectrum through the system. In some variations, the color wheel is configured to perform the color transition from light of the first color to the light of second color. In some embodiments, the color display system includes a color switch coupled to the display panel. In some variations, the color switch is configured to perform the color transition from the light of first color to the light of second color.

In some embodiments, a method for driving a color display system is described. In some variations, the method includes loading data into one or more buffers, wherein the one or more buffers correspond to one or more pixels of the color display system. In some variations, the method includes concurrently switching the one or more pixels to an off-transmission state and writing the data to the one or more pixels from the corresponding one or more buffers.

The foregoing is a summary and shall not be used to limit the scope of the claims. The operations disclosed herein may be implemented in a number of ways, and such changes and modifications may be made without departing from this invention and its broader aspects. Other aspects, inventive features, and advantages of the present invention(s), as defined solely by the claims, are described in the non-limiting detailed description set forth below.

Figure 1:
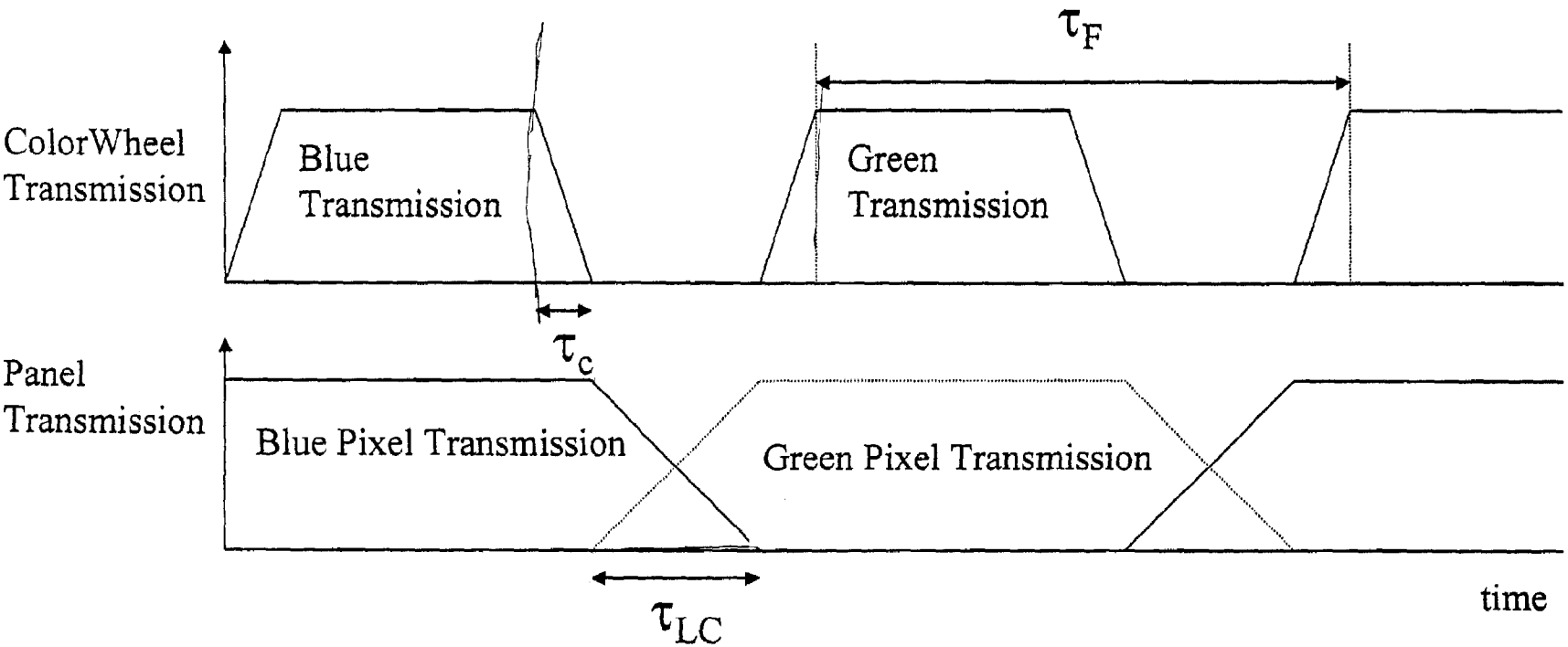
FIG. 1 PRIOR ART
FIG. 1 illustrates a prior art timing diagram.

All of these drawings are drawings of certain embodiments. The scope of the claims is not to be limited to the specific embodiments illustrated in the drawings and described below.

DETAILED DESCRIPTION OF THE EMBODIMENTS

FIG. 1 illustrates the timing diagram of a prior art color wheel based projector. The timing diagram illustrates the time that a black segment blocks illumination from the color wheel. Initially, the black segment reduces or blocks light from a first color field or section as the color wheel transitions from illuminating a display panel to a dark state. Next, the black segment blocks the light from the color wheel while the liquid crystal is allowed to change states. This interval is represented by $\tau_{LC}$ in FIG. 1. For a progressive scan panel, $\tau_{LC}$ may also include the time required to write the data. Finally, the black segment reduces or blocks light from a second color field or section as the color wheel transitions from the dark state to illuminating the display panel. The light from the color wheel may be utilized by the panel during a transition time $\tau_c$, to the black state which is part of the color transition time. The brightness varies from 0% to 100% during the transition and has an average brightness of 50%.

The black segment is made sufficiently large to insure that the blanking time will be sufficiently long to allow the liquid crystal to settle to a high contrast state, which occurs after $\tau_{LC}$, such that a high contrast display is maintained. The color wheel then begins illuminating with the next color section and full transmission occurs after another transition time $\tau_c$ that goes from the black state to a color transmissive state. This results in global temporal notching. The total light loss from the global temporal notching is $(\tau_c+\tau_{LC})/\tau_F$, where $\tau_F$ is the field duration. In FIG. 1, the global temporal, in certain instances depending on the different relevant periods, notching loss is a fixed loss that occurs irrespective of pixels states and reduces the brightness by 10-30%.

Frame buffered silicon backplane liquid crystal display (LCD) panels such as described in U.S. Pat. Nos. 6,225,991, 6,295,054 and 6,369,832, all of which are incorporated herein by reference, allow additional functionality to be incorporated into the addressing structure, in part, through the fabrication of multiple transistors and/or other elements beneath each pixel. One function that may be incorporated into frame buffered silicon backplane LCD panels is the simultaneous switching of a block of pixels of the display or the entire display. This substantially reduces the writing time of the display, which results in a substantially reduced blanking time. Since the entire display is simultaneously switched, the blanking time may be limited to the response time of the liquid crystal. Thus, the brightness of the display is increased due to the reduced blanking time, which causes a greater percentage of the light source light to be utilized.

Figure 2:
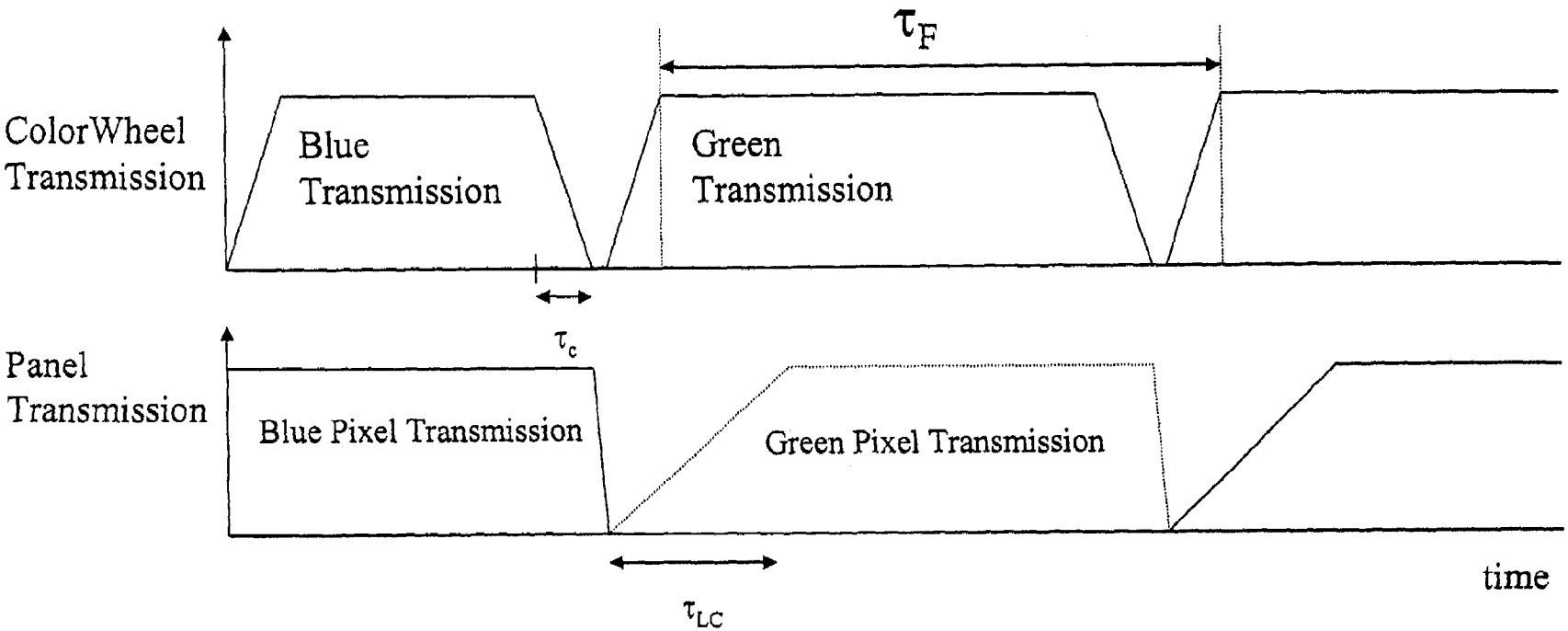
FIG. 2 illustrates a timing diagram for a sequential color system with fast global blanking.

FIG. 2 illustrates the timing diagram of a buffered display with a rapid global panel blanking function that reduces the global temporal notching. The width of the blanking notch shown in FIG. 2 may be narrowed by providing a rapid global panel blanking function. However, a compromise between color saturation and brightness may need to be made since the depth and duration of the global temporal notching dictates the extent of color mixing and therefore, the color coordinates. Thus, the black segments (as shown by the 0% color wheel transmission regions) are still included in FIG. 2 in order to eliminate color mixing. Although improved, FIG. 2 still has global temporal notching losses.

The above reduction in global temporal notching losses may be achieved by using a normally white panel and exploiting the asymmetric switching of nematic liquid crystals. By driving all pixels with a high voltage after viewing a field, a global black state may be obtained in less than 100 microseconds. White pixels immediately begin relaxing to a fully transmissive state while black pixels remain driven high. Still further reductions may be achieved by having the color wheel transition to the subsequent field while on-pixels of the panel are relaxing to the fully transmissive state, as shown in FIG. 2.

Figure 3:
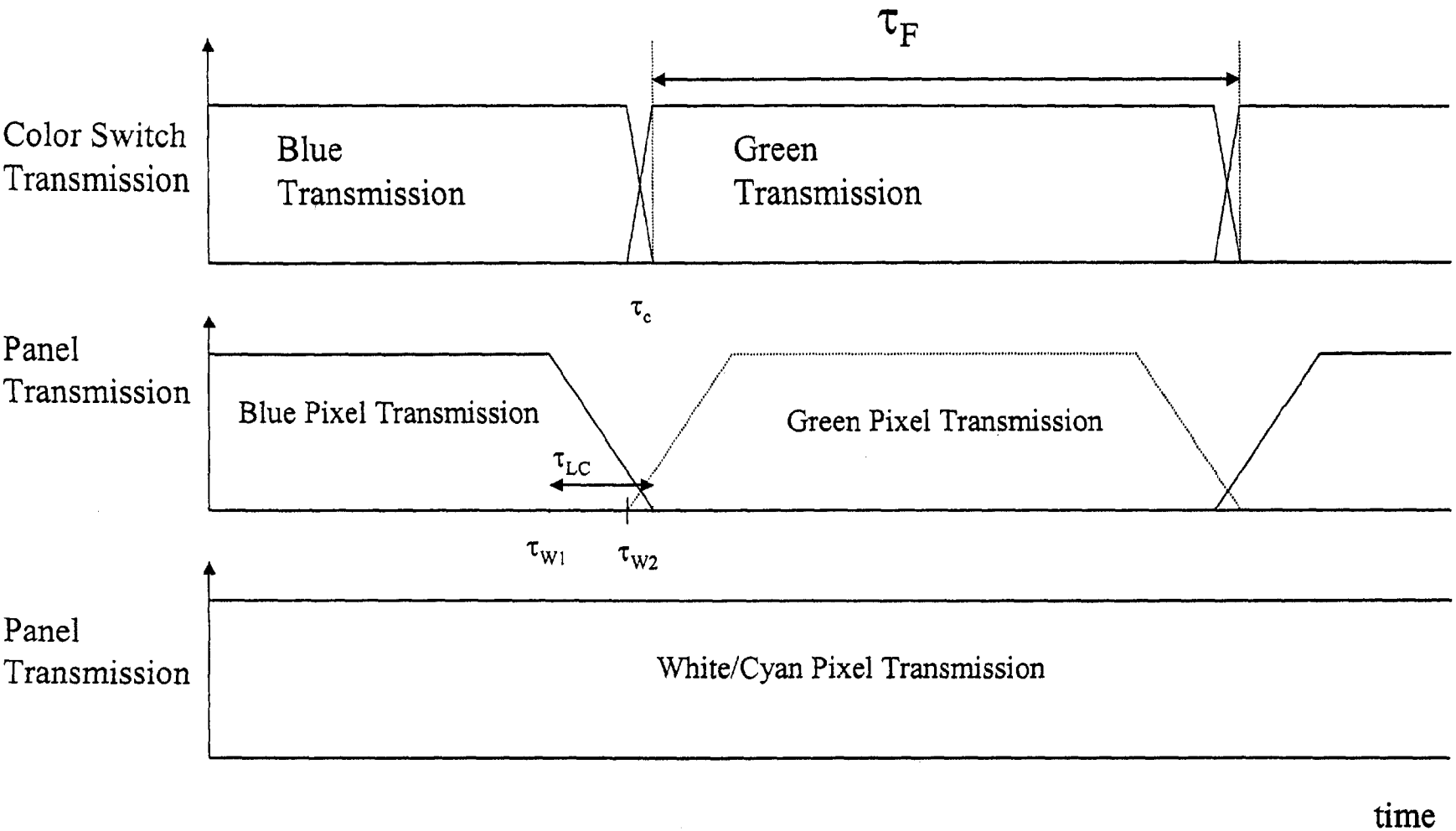
FIG. 3 illustrates a timing diagram for a sequential color system with inter-field images.

FIG. 3 illustrates a timing diagram for a two-panel system using inter-field images. One panel of the two-panel system is a fixed color panel while the other panel sequentially alternates between two, or more, colors. This example corresponds to a red panel used in combination with a sequential blue-green panel. The two-panel system of FIG. 3 operates by switching a fully saturated blue pixel to a black state while keeping a fully saturated green pixel in the black state. However, when two consecutive fields are transmitted such as for a white or cyan pixel, a pixel may be maintained in the fully transmitting state. An inter-field image provides pixel-by-pixel control of temporal notching, or local temporal notching. The inter-field image is displayed during the transition between color fields and during the time a pixel would otherwise be changing states. The local temporal notching may be accomplished using a frame-buffered panel with sufficient speed that two or more images can be written during the transition between fields.

Inter-field images may be provided by the additional functionality programmed into a buffered panel. This inter-field image allows for the substantial reduction of global temporal notching losses for consecutive "on" states. Additionally, the black segment may be eliminated due to the use of a buffered panel. In a system without a black segment on the color wheel, the global temporal notching losses for consecutive "on" color fields may be eliminated.

For FIG. 3, the panels may utilize a symmetric switching time where the black pixels settle in time $\tau_{LC}$ Once a set of data is transferred to a panel, a new data set is loaded into the frame buffers such that the data set may be rapidly transferred to the panel. An exemplary method of operation is beginning to turn a pixel "off" at time $\tau_{w1}$ when the state is to be changed from "on" to "off", beginning to turn a pixel "on" at a time $\tau_{W2}$ when the state is to changed from "off" to "on" and maintaining a pixel in its current state when the state is not to be changed. The delay between $\tau_{W1}$ and $\tau_{W2}$ depends upon the panel load time and the liquid crystal response time. The delay is determined by the amount of switching overlap that is tolerable given the saturation requirements provided, the load time and response time are not limiting factors. Thus, a white or cyan pixel will remain in the fully transmitting state and have zero or substantially zero global temporal notching losses while a pixel transitioning between "on" and "off" states (e.g., pixel is green or blue and not cyan) will have global temporal notching losses. This is shown by the constantly "on" panel transmission state of the white/cyan pixel transmission. Other degrees of saturation permit analog control of local temporal notching, such that a particular pastel may have a notch with 50% depth.

Further to pixel transitions from one transmission level to another transmission level, in some instances the relative transmission levels from one field to another may be close enough such that it may be desirable that the pixel value not be reset between fields. For example, the transmission level of a pixel in one field may be within 20% of the transmission level of that pixel in the next field. In such instance, it may be desirable to give that pixel a transmission level of between the two field transmission levels as a part of the inter-field image. Thus, for instance, if a pixel transmission level is 50% in a first field and as 70% in a second field, the inter-field image may be used to update the pixel value to be 50%, 55%, 60%, 65%, 70%, or some other value depending on design considerations.

System level performance improvement may be realized by incorporating local temporal notching into the panel when the color modulator is also free from global temporal notching. Color wheels, for example, have a color mixing interval due to the finite spot size on the spokes and do not have a system level performance improvement. A black segment is typically incorporated to eliminate this color mixing time, thereby causing global temporal notching loss. Conversely, a color modulator with insignificant color mixing time is free from global temporal notching. Thus, a color modulator with insignificant color mixing time will have the benefits of panel local temporal notching.

As an alternative to the color wheel, a color switch can pass red in all voltage states, while rapidly modulating between full transmission of blue with no green, and full transmission of green with no blue (magenta/yellow color switch). Such a device can be implemented using a one-bit switch using color-selective light modulator technology such as shown in U.S. Pat. No. 5,990,996, which is incorporated herein by reference.

A crossed π-cell switch allows fast switching in both directions. In the 00 state (0=V-low and 1=V-high), magenta is transmitted. When one cell is energized, yellow is transmitted (half-wave state). When the second cell is energized (11-state), magenta is again transmitted. When both cells are returned to the 00-state there is no change in the optical state. In such a configuration, 10-20 microsecond switching may be obtained between both magenta/yellow and yellow/magenta using 20-30 volt signal. Alternatively, ferroelectric liquid crystals or other materials may be used which provide appropriate switching times in a single cell.

Thus, field sequential projection systems with frame-buffered display panels that add one or more inter-field images may have improved brightness and color saturation. A system comprising a panel that provides local temporal notching, and a 10-20 microsecond color modulator may provide both saturated primaries with almost complete elimination of temporal notching of white pixels.

Figure 4:
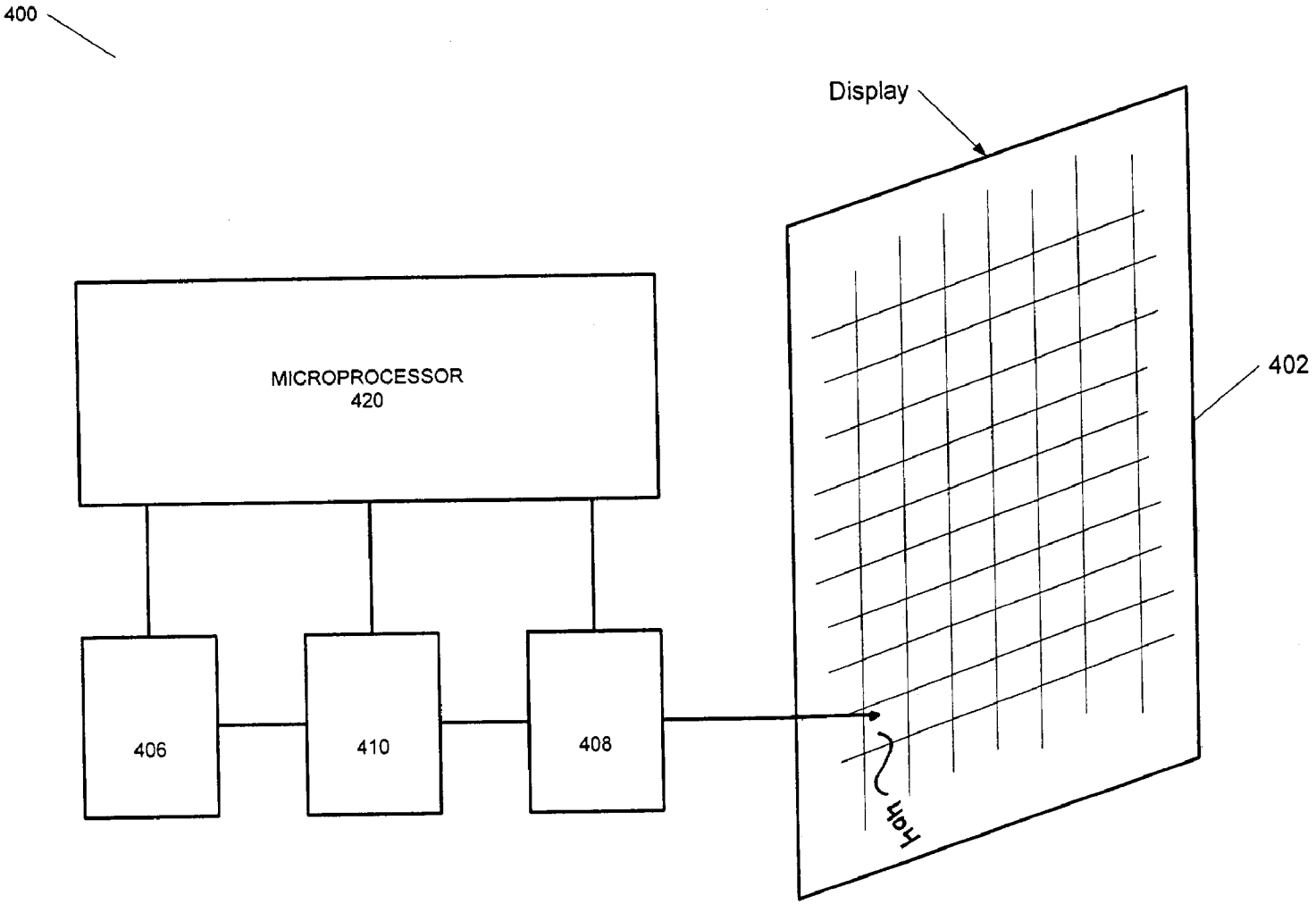
FIG. 4 illustrates a first exemplary block diagram for a sequential color system with frame buffering.

FIG. 4 illustrates a exemplary block diagram for a sequential color system with frame buffering 400. Shown in FIG. 4 is a display 402 having a plurality of pixels 404. Buffers 406, 408, and 410 are provided, which store transmission states for multiple frames or fields of image data. Illustrated in this figure is buffering (buffers 406, 408, and 410) for a single pixel, and that buffering might provide a single bit of storage per pixel per buffer, for example when a pixel has two possible states—on and off. Alternatively, the buffering might provide multiple bits (e.g., 8 or 16 bits) of storage such as when a transmission value is provided for each pixel. The buffers in this example are provided in serial order, such that buffer 408 would contain the image data presently being displayed on the display panel 402 and buffer 406 would contain the image data to be presented in the next field or frame. The buffer 410 is provided in this example to store inter-field image data, whereby the microprocessor could compare the data being displayed in the display 402 to the data to be displayed in the next field, and in those instances where the pixel data is the same or is to have a transmission state (or transmissivity) that is relatively close to the next field or frame image, then that pixel may be kept in its present state or updated in the inter-field buffer 410 with inter-field image data to be applied between the fields or frames in order to improve image performance. The microprocessor or other controller (such as a specialized display controller) 420 is operable to supervise the operations of the buffers 406, 408, and 410, the comparison of pixel data between the buffers 406 and 408, the computation and storage of inter-field image data into the inter-field data buffer 410, and the transfer of data among the buffers 406, 408, 410 and the display 402.

Figure 5:
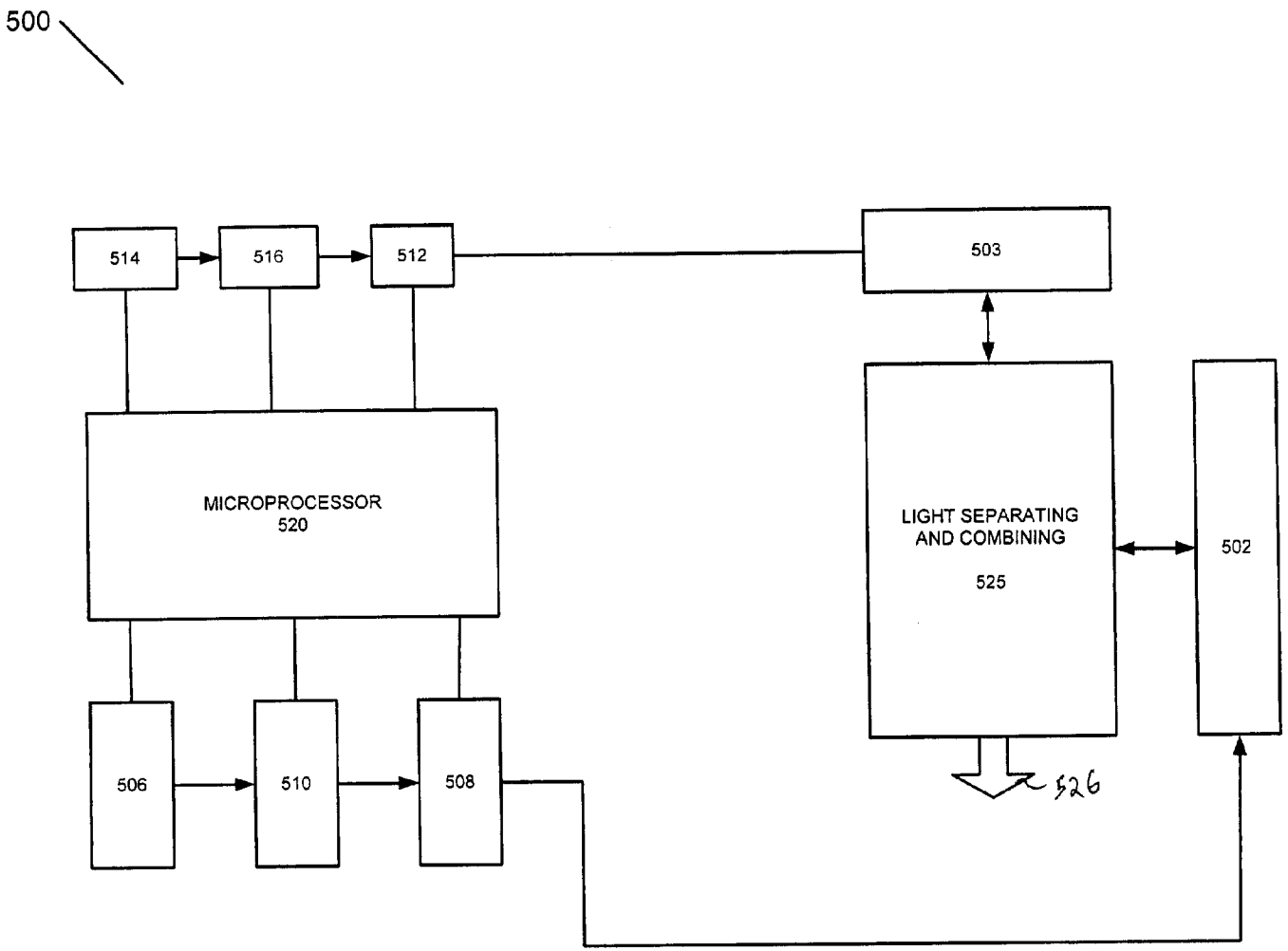
FIG. 5 illustrates a second exemplary block diagram for a sequential color system with frame buffering.

FIG. 5 illustrates a exemplary block diagram for another sequential color system with frame buffering 500. Shown in FIG. 4 are two display panels 502, 503, whose light output can be combined in different fashions to produce a single color image using the image separation and combination block 525 with its image output 526. This embodiment operates in a similar manner to the embodiment of FIG. 4, but there are provided separate sets of buffers for each panel in this embodiment. Thus, buffers 506, 508, and 510 provide the roles described for buffers 406, 408, and 410 respectively as described with respect to FIG. 4, but would be dedicated to display panel 502, whereas buffers 512, 514, and 516 provide those roles but would be dedicated to display panel 503. In the event that one of the display panels handled two colors sequentially, then, the buffers devoted to that panel would have field data for both of those colors stored simultaneously. For example, if the panel 503 was a blue/green panel, the buffer 512 might store green field data while buffer 514 stored blue field data. The inter-field buffer 516 would contain transitional data for optimal handling of the display during transition between the two colors. As before, the microprocessor or other microcontroller 520 would play a supervisory role for these operations, and the buffers might contain one or multiple bits per pixel. The display panels 502, 503 are not illustrated as having pixels, but their form would be similar to the one shown for panel 402, whereby they would each have a multiple buffered pixels and a plurality of buffers would be connected to those plural pixels.

The present invention may be implemented as a two-panel system. For example, a two panel system including a red panel and a blue/green sequential panel. Alternatively, other color combinations may be used. Furthermore, additional sequential and non-sequential panels may be included. For example, the invention can be implemented on a multiple panel display system where individual panels can represent a color (e.g., primary colors red, blue, and green). The pixels of each color panel that have "on" state between two colors can be maintained in the "on" state during the transition. Alternatively, the present invention may be implemented as a single panel system. Full color single-panel systems may benefit significantly from local temporal notching, since switching time is a substantial percentage of field duration. Other alternative may include various color-mixing intervals since, as a percentage of field time, color-mixing intervals are thus short and have little effect on saturation. Alternatively, the present invention may be applied to monochromatic devices.

Although several embodiments have been described in detail above, it should be understood that changes, substitutions, transformations, modifications, variations, permutations and alterations may be made therein without departing from the teachings of the present invention(s). It is to be understood that the scope of the invention(s) also encompasses embodiments different from those described, yet within the scope of the claims. Words of inclusion are to be interpreted as nonexhaustive in considering the scope of the invention. While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

For example, although certain embodiments are described as using a single panel for sequentially modulating green and blue light data, other colors can be combined and similar principles can be used for updating the pixel values, including the use of inter-field pixel values, can be used for those other colors. While certain embodiments are described with respect to active matrix liquid crystal displays, the principles disclosed can be used for other types of displays, and the specific types of displays listed in the described embodiments should not be used to limit the application of the claimed invention(s). Microcontrollers or microprocessors can also include logic state machines or other control circuitry. "Relatively close" may be understood by one of ordinary skill in the art in light of the design considerations expressed in this application. In general, the skilled artisan would understand that in those circumstances where a pixel value can be maintained between fields due to small changes in transmissivity relative to the reaction time of the display or other factors, it may be advantageous to image quality to maintain the pixel values in their current state or in an intermediate state during the field update transition between a first and second color image component display.

The section headings in this application are provided for consistency with the parts of an application suggested under 37 CFR 1.77 or otherwise to provide organizational cues. These headings shall not limit or characterize the invention (s) set out in any patent claims that may issue from this application. Specifically and by way of example, although the headings or other parts of the specification may refer to a "Field of the Invention," the claims should not be limited by the language chosen under this heading to describe the so-called field of the invention. Further, a description of a technology in the "Description of Related Art" is not be construed as an admission that technology is prior art to the present application. Neither is any "Summary of the Invention" to be considered as a characterization of the invention (s) set forth in the claims to this application. Further, the reference in these headings, or elsewhere in this document, to an "Invention" in the singular should not be used to argue that there is a single point of novelty claimed in this application. Multiple inventions may be set forth according to the limitations of the multiple claims associated with this patent specification, and the claims accordingly define the invention(s) that are protected thereby. In all instances, the scope of the claims shall be considered on their own merits in light of the specification but should not be constrained by the headings included in this application.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Boundaries between various components described in the specification are not intended to be limiting, other allocations of functionality will fall within the scope of claims that follow. Finally, structures and functionality presented as discrete components in the exemplary configurations may be implemented as a combined structure or component. These and other variations, modifications, additions, and improvements may fall within the scope of the invention as defined in the claims that follow.

What is claimed is:

1. A method in a color display system for displaying first and second color component image fields, wherein the second color component image field is subsequent to the first color component image field in time, the method comprising:

establishing a first color component image on a multiple pixel display, each pixel of the display being set to at least one of first and second transmission states, wherein the setting of the pixels is to present the first color component image field on the display;

examining a second color component image field to be presented on the display;

determining which pixels of the display in presenting the second color component image field are to have transmission states that are relatively close, the relatively close pixels having a relative transmissivity substantially equal to or within 20 percent of their respective transmission states in the first color component image field; and establishing a second color image on the multiple pixel display by resetting the transmission states of a plurality of the pixels of the multiple pixel display without resetting the transmission state of at least some of the pixels that are to have the relatively close transmission states relative to their states in displaying the first color component image field.

2. A method according to claim 1, wherein the possible transmission states of the pixels are an on-transmission state and an off-transmission state.

3. A method according to claim 1, wherein the possible transmission states are a plurality of values representing the relative transmission levels for the pixels.

4. A method according to claim 1, wherein the color display system is a buffered panel color display system including one or more buffers, and wherein the one or more buffers are operable to store values representing the transmission states of the pixels for the first and second color component image fields.

5. A method according to claim 1, wherein the color display system includes at least two panels, wherein a first panel is a fixed color panel; and a second panel is a sequential color panel configured to sequentially alternate between two or more colors.

6. A method according to claim 1, wherein the color display system includes a multiple panel color display; and the first and the second color component image fields are displayed on at least one panel of the multiple panel color display system.

7. A method according to claim 1, further comprising displaying an inter-field image between the display of the first color component image field and the second color component image field, wherein the inter-field image is configured to relatively maintain the transmission state of the at least some pixels that are to have the relatively close transmission states in the first and second color component image fields.

8. A method according to claim 7, wherein the pixels in the inter-field image that are to be relatively maintained are given transmission states in the inter-field image of approximately between their transmission states in the first and second color component image fields.

9. A method according to claim 1, further comprising changing the transmission state of the plurality of pixels that are being reset concurrently with the transition of the first color component image field to the second color component image field.

10. A method according to claim 1, wherein the transition from the first color component image field to the second color component image field is performed together with the color transitions of a light source imposed by a color wheel.

11. A method according to claim 1, wherein the transition from the first color component image field to the second color component image field is performed together with the color transitions of a light source imposed by a color switch.

12. A method according to claim 11, wherein the color switch is selected from the group consisting of a one-bit color switch and a crossed π-cell color switch.

13. A color display system comprising:

a display having a plurality of pixels;

one or more buffers, at least a first of the one or more buffers being coupled to the display, the one or more buffers operable to store values representing the transmission states of the pixels for one or more display fields corresponding to the pixels;

a control circuit coupled to the one or more buffers, the control circuit operable to:

establish pixel data for a first color component image field in a first of the one or more buffers;

establish the pixel data for the first color component image field on the display, each pixel of the display being set to at least one of first and second transmission states, thereby setting the pixels of the display to correspond to the pixel data for the first color component image field;

establish pixel data for a second color component image field in a second of the one or more buffers;

compare the pixel data for the second color component image field to the pixel data for the first color component image field; and establish the second color component image field on the display without resetting the transmission state of at least some of the pixels that have transmission states that have a relative transmissivity substantially equal to or within 20 percent of their respective transmission states in the first color component image field.

14. A color display system according to claim 13, wherein the possible transmission states of the pixels are an on-transmission state and an off-transmission state.

15. A color display system according to claim 13, wherein the possible transmission states are a plurality of values representing the relative transmission levels for the pixels.

16. A color display system according to claim 13, wherein the color display system is a sequential color display system.

17. A color display system according to claim 16, wherein the color display system includes at least two panels, wherein a first panel is a fixed color panel; and a second panel is a sequential color panel configured to sequentially alternate between two or more colors.

18. A color display system according to claim 13, wherein the color display system is a multiple panel color display system; and the color display system is further configured to display the first and the second color component image fields on at least one panel of the multiple panels.

19. A color display system according to claim 18, wherein the color display system is further configured to establish the second color component image field without transitioning the transmission state of the at least some of the pixels of the second color component image field that have transmission states that are relatively close to those pixels' transmission states in the first color component image field.

20. A color display system according to claim 13, wherein the color display system is further configured to display an inter-field image during transition from the first color component image field to the second color component image field, wherein the inter-field image is configured to relatively maintain the transmission state of the at least some pixels that are to have relatively close transmission states in the first and second color component image fields.

21. A color display system according to claim 13, wherein the color display system is further configured to change the transmission state of those pixels that are not to have the same transmission state in the second color component image field as in the first color component image field concurrently with the transition of the first color component image field to the second color component image field.

22. A color display system according to claim 13, wherein the display operates by modulating a light source, and further comprising a color wheel coupled to the display, wherein the color wheel is configured to perform the transition of the light source for the display from the a first color component to a second color component in a synchronized manner with the display transition from the first color component image field to the second color component image field.

23. A color display system according to claim 13, wherein the display operates by modulating a light source, and further comprising a color switch coupled to the display, wherein the color switch is configured to perform the transition of the light source for the display from a first color component to a second color component in a synchronized manner with the display transition from the first color component image field to the second component color image field.

24. A color display system according to claim 23, wherein the color switch is a one-bit color switch.

25. A color display system according to claim 23, wherein the color switch is a crossed π-cell color switch.

26. A color display system according to claim 13, wherein the display is an active-matrix display panel.

* * * * *